United States Patent [19]

St-Germain

[11] Patent Number: 4,809,814

[45] Date of Patent: Mar. 7, 1989

[54] SCAFFOLDING

[76] Inventor: Jean St-Germain, 1350 Rang Saint-Georges, Saint-Simon, Canada, J0H 1Y0

[21] Appl. No.: 177,539

[22] Filed: Apr. 1, 1988

[51] Int. Cl.[4] ..... E04G 1/20

[52] U.S. Cl. ..... 182/132; 182/146; 182/118

[58] Field of Search ..... 182/146, 136, 145, 63, 182/130–132, 118

[56] References Cited

U.S. PATENT DOCUMENTS

| | | | |
|---|---|---|---|
| 1,168,868 | 1/1916 | Ericsson | 182/146 |
| 2,616,769 | 11/1952 | Rector | 182/146 |
| 2,851,125 | 9/1958 | Moyer | 182/146 |
| 2,947,148 | 8/1960 | Young | 182/136 |
| 3,318,414 | 5/1967 | Meek | 182/146 |
| 3,323,616 | 6/1967 | Best | 182/146 |
| 3,438,460 | 4/1969 | Slari | 182/146 |
| 3,610,368 | 10/1971 | Johnson | 182/146 |
| 4,293,054 | 10/1981 | Pieri | 182/146 |
| 4,294,332 | 10/1981 | Ready | 182/132 |
| 4,641,728 | 2/1987 | McCabe | 182/146 |

*Primary Examiner*—Reinaldo P. Machado

[57] ABSTRACT

This scaffolding comprises a base, a pair of spaced posts on said base each formed of modular post sections, releasably secured one on top of the other by fasteners. Each post section is formed of a lattice frame with transversely-extending bars forming anchoring steps, equally spaced along the post. A work platform surrounds the posts and is guided therealong for up-and-down movement. A pair of anchoring hooks are pivoted at theri lower end to the platform and are engageable with the steps of the two posts to suspend the platform. A pair of hydraulic rams are pivoted also to the platform adjacent each post and upwardly-upstanding piston rods are provided with hooks to engage the steps of the post and raise or lower the platform. The hydraulic supply for the rams is mounted on the platform. The hook members are biased towards the posts, so that they automatically engage the steps. A single operator can operate the rams to raise and lower the work platform. The same operator can install the modular post sections as the platform is being raised and can dismantle when the platform is lowered. A swing stage is supsended from the work platform by flexible cables. The operator can climb down on the work stage to install bracing bars for interconnecting the posts as the platform is raised and to attach tie-rods to the posts and to an adjacent building wall to be covered with bricks or the like, which is carried by the platform.

16 Claims, 10 Drawing Sheets

SCAFFOLDING

FIELD OF THE INVENTION

The present invention relates to scaffolding and, more particularly, to scaffolding arranged to be erected along a building wall for the use by workmen to install a lining on the wall, such as brickwork.

BACKGROUND OF THE INVENTION

Conventional scaffolding of the above-noted type usually consists of detachable frame elements arranged to be handled by one or two men and to be connected one on top of the other as men work their way upwardly along the erected scaffolding elements. This is very dangerous work and accidents frequently happen. Also, bricks, motor and/or other material used to apply a lining to the adjacent building wall must be hoisted in small quantities, since the load capable of being carried by this scaffolding is quite small. This type of scaffolding must also be erected very close to the wall, and whenever there is an obstruction, such a balcony or the like protruding from the wall, scaffolding erection becomes very complicated, and so is the brickwork laying. There has been recently introduced on the market a scaffolding arrangement composed of a pair of posts, made of modular sections and which must be each erected to the desired height by expensive means, such as a crane with a long boom. Then cables have to be trained on pulleys mounted on the top of each post, to be connected to a platform to be raised by the cables. This is an expensive and again often dangerous way of erecting scaffolding. Moreover, the latter type of scaffolding can only carry a limited load.

OBJECTS OF THE INVENTION

The general object of the present invention is to provide scaffolding more particularly adapted to be mounted adjacent a building wall, which obviates the above-noted disadvantages in that it has posts and a work platform capable of supporting a high load, including sufficient wall lining material, and in that power means raise the platform up the posts which are formed of modular element capable of being installed by a workman on the platform as the latter is being raised.

Another object of the present invention is to provide scaffolding of the character described, having means enabling the workman on the platform to install braces for the posts and tierods from the posts to the building wall to stabilize the posts as the platform is being raised and to permit installation of the scaffolding at a distance from the building wall sufficient to clear balconies and the like which may protrude from the building wall.

Another object of the present invention resides in a novel means to raise and lower the platform and its load along the posts.

Another object of the present invention resides in the provision of platform extensions which can be secured to the work platform itself to extend adjacent the building wall, despite the uneven contour of said wall.

Another object of the present invention is to provide scaffolding of the character described, which can be very quickly installed and which enables much faster wall lining than when using previously-known scaffolding structures.

SUMMARY OF THE INVENTION

The scaffolding of the invention basically comprises a base, a pair of spaced posts secured to and upstanding from the base, each post formed of modular post sections, fasteners means to releasably, successively secure said post sections one on top of the other, said posts forming substantially equally-spaced step means; a work platform surrounding the posts and capable of being raised and lowered along said posts, a pair of anchoring members pivotally carried by the work platform adjacent each post and alternatively and successively engageable with the step means to suspend the work platform from the posts at different levels; at least one anchoring member of said pair being a power-actuated member extendible and retractable along said post relative to the work platform through a stroke at least equal to the vertical spacing between adjacent step means, said platform raisable and lowerable by said extendible members, biasing means associated with said members to cause automatic engagement of the same with said step means as said platform is raised or lowered, the members of the pairs alternately engaging the step means to suspend the platform as the latter is raised or lowered by the extendible members of the pairs, the post sections arranged to be secured or removed by a workman on said platform onto or from each topmost secured post section when the platform is at a general level of said topmost post section. Each pair of members may be a power-actuated, extendible member. However, it is preferred to have one extendible member in the pair while the other member of the pairs is a simple arm pivoted to the platform and biased towards the post by a spring means. The extendible member is preferably comprised of a double-acting hydraulic ram pivoted to the platform at one end and having its other end provided with a step-engageable member. Preferably, both members extend upwardly from their lower pivoted end to the platform and the step-engaging members are in the form of downwardly-opening hooks engageable with transverse bars constituting the step means on the post sections. Each hook is preferably provided with an upwardly-extending guide mamber slidable along the next higher transverse bar as the platform is being raised, so as to pivot the members away from the post and allow the hook to clear the next higher transverse bar. Preferably, a swing stage is suspended from the work platform by means of flexible cables and is accessible to the workman on the platform. The swing stage carries support means for tie-rods and braces to be installed by a workman underneath the platform betweeen the posts and the wall and between the posts themselves, respectively, as the platform is being raised.

DETAILED DESCRIPTION OF THE PREFERRED EMBODIMENT

Figure 1:
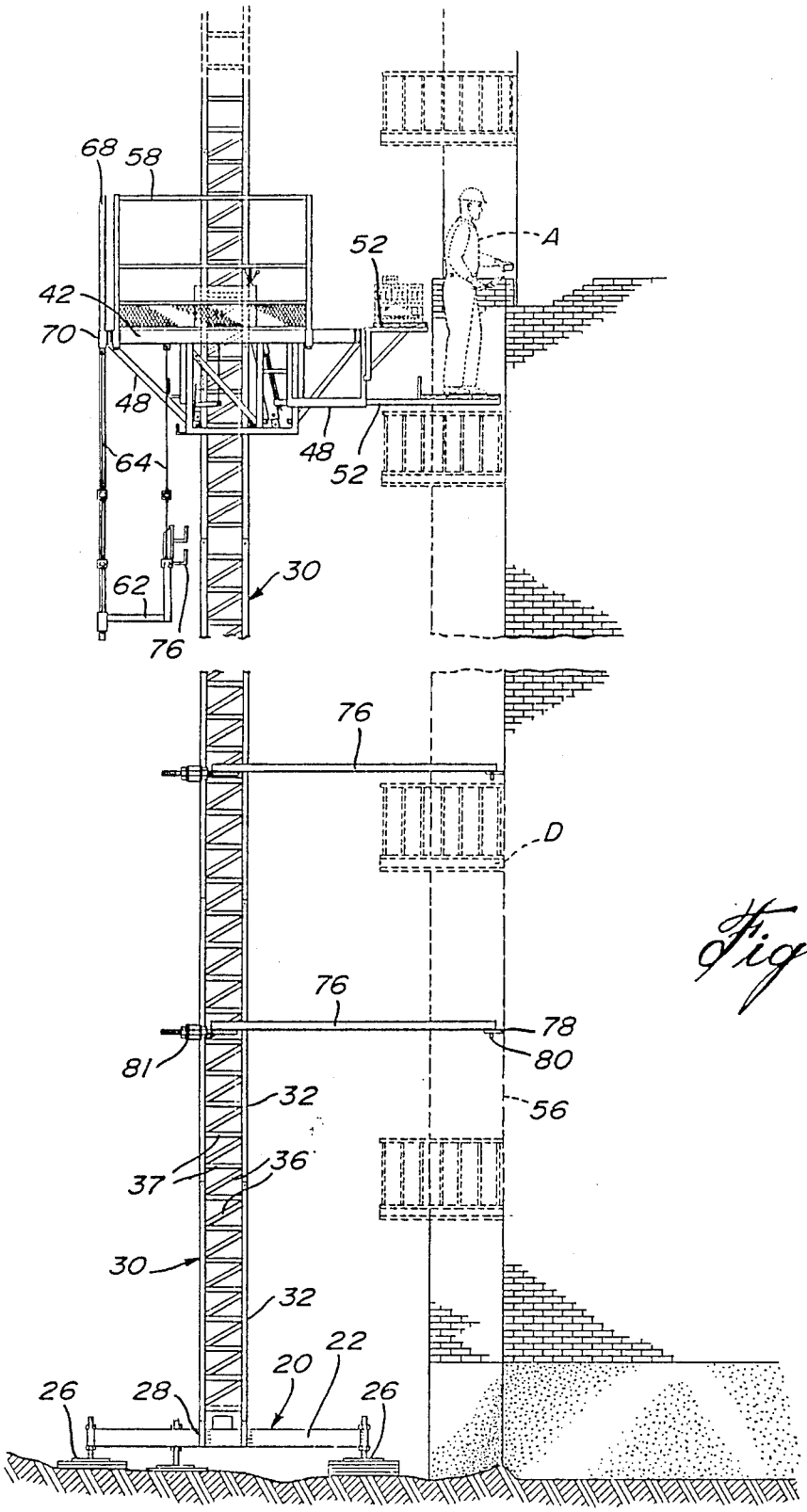
FIG. 1 is an end elevation of the scaffolding in erected condition along a building wall being covered with bricks.
Figure 2:
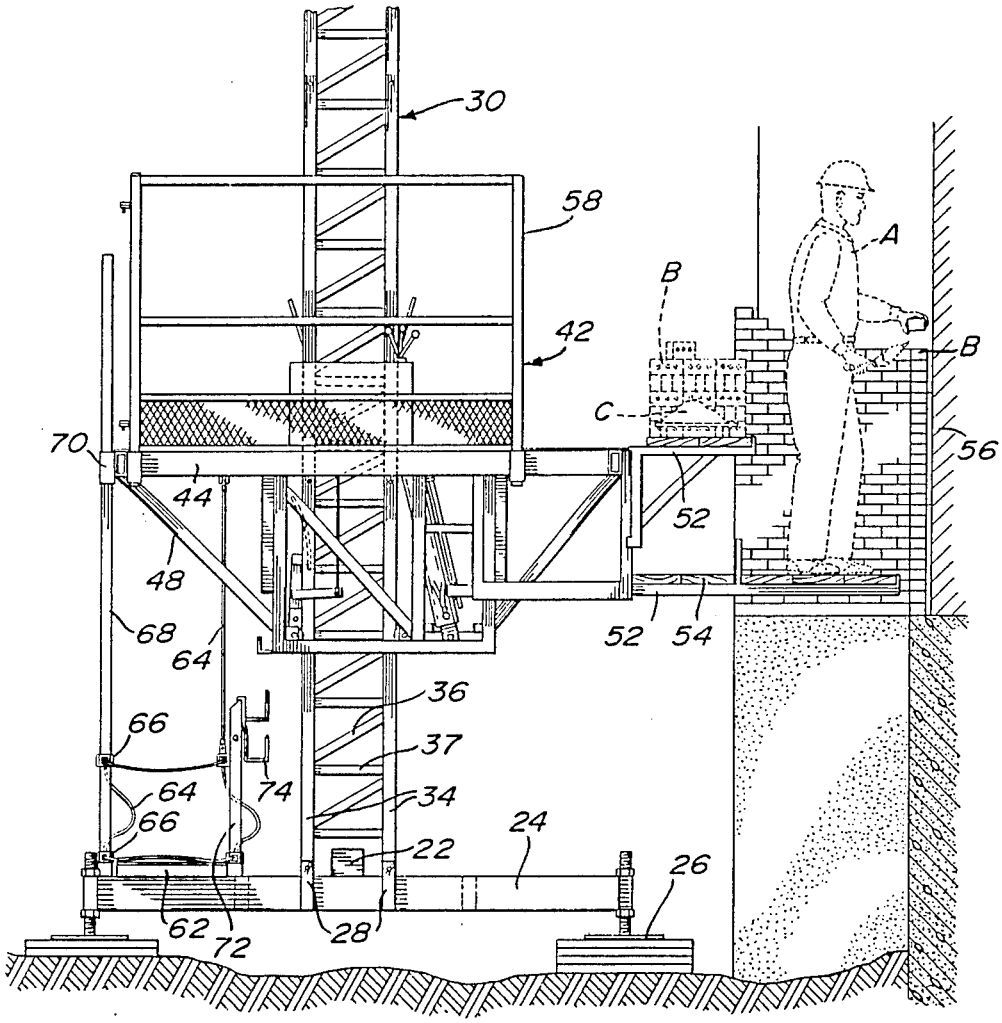
FIG. 2 is an end elevation similar to that of FIG. 1, but on an enlarged scale and with the work platform practically at ground level.
Figure 3:
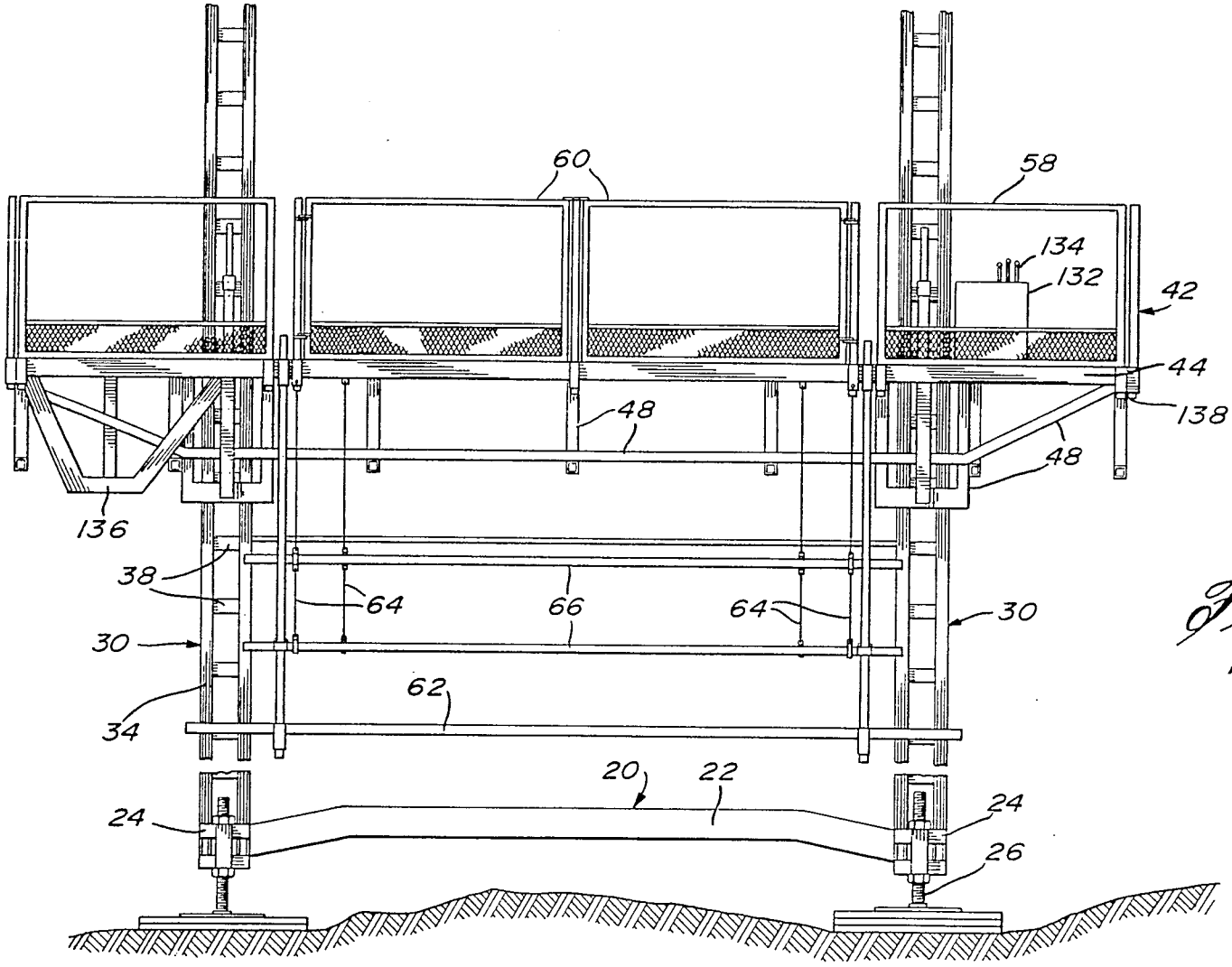
FIG. 3 is a side elevation of the scaffolding.
Figure 5:
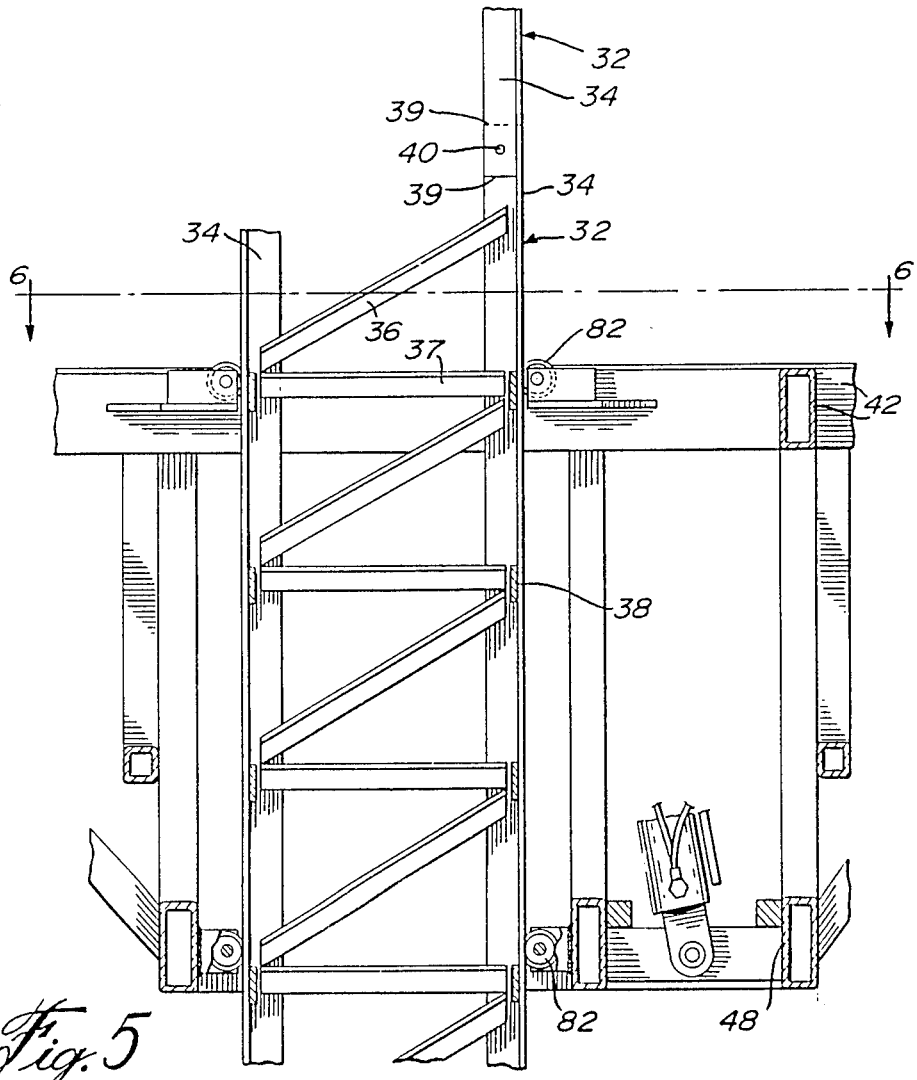
FIG. 5 is a vertical section through one post and through the working platform.

Referring to FIGS. 1, 2, and 3, there is shown a rigid base 20 formed of a central beam 22 and two end transverse beams 24 from each end of which downwardly extends an adjustable levelling pad 26. At the junction of the end beams with the central beam, are fixed four upright tubes 28 disposed at the corners of a rectangle. Each group of four tubes 28 are arranged to support and fix an upstanding post 30. Each post is composed of modular post sections 32. Each post section is formed of an open lattice work frame having a rectangular cross-section and comprising four longitudinally extending corner angle members 34 interconnected by inclined braces 36 and by transverse braces 37 along two opposite faces of each post and by transverse bars 38 along the two other opposite faces of each post 30. When the post sections are interconnected one on top of the other, the transverse bars 38 are equally vertically spaced and form anchoring steps. Preferably, the loewr end of the corner members 34 of each post section is provided with protruding plate 39 engageable within the upper end of the corner members 34 of the next lowermost post section, these plates being anchored in place by transverse pins 40 extending through registering holes in the assembled parts, as shown in FIG. 5. Each post section 32 is of such a height and weight so that it can be easily handled by one workman, by means of a hand-hoist if necessary, on a work platform 42 suspended from the two posts. Therefore, the several post sections 32 can be carried by the work platform 42 and successively installed one on top of the other as the platform is being raised and dismantled as the platform is lowered.

Figure 4:
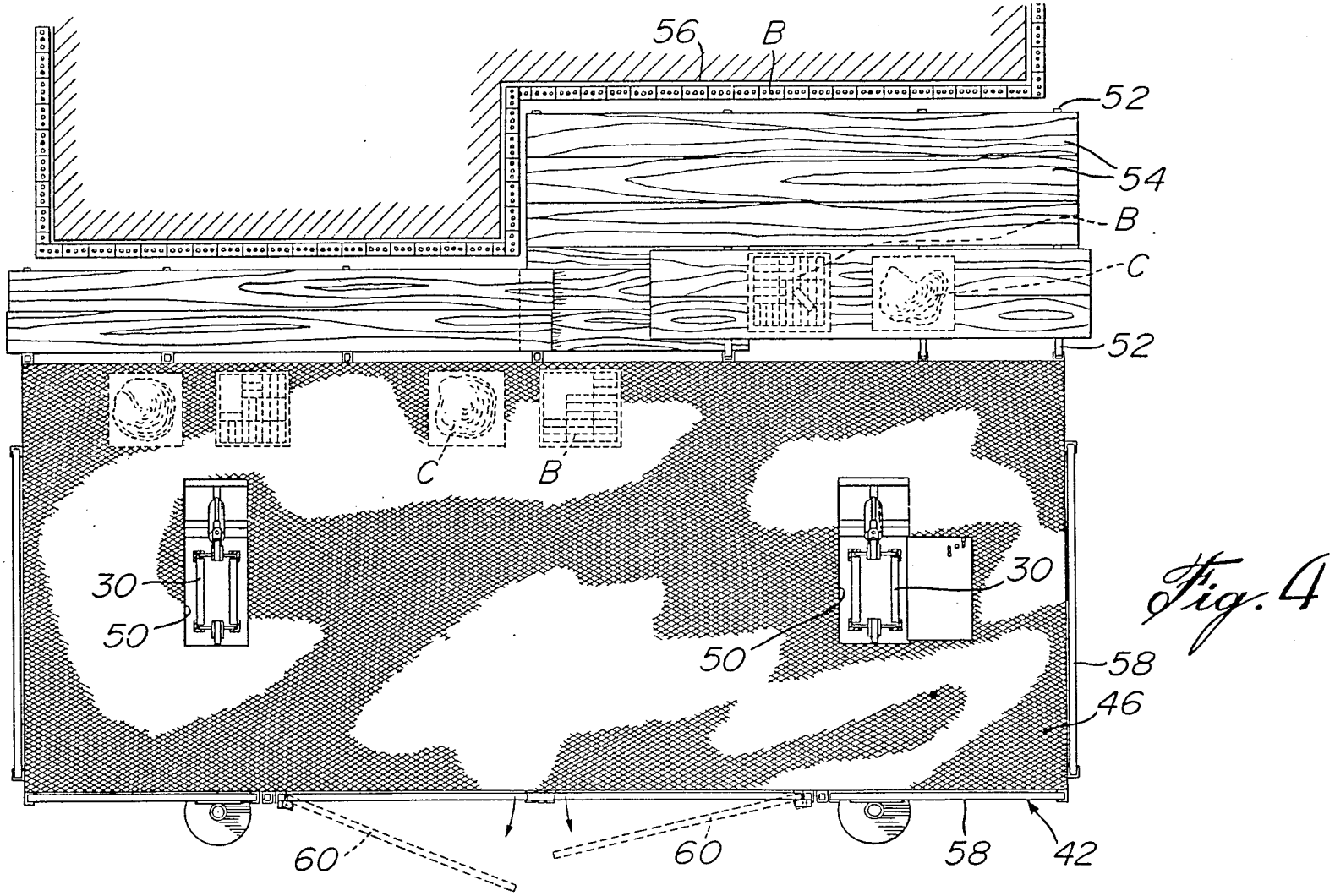
FIG. 4 is a top plan view of the same.

Referring to FIGS. 2, 3, and 4, the work platform 42 is of generally rectangular shape and comprises a main framework 44 directly supporting a flooring 46, the framework 44 being reinforced underneath by an underframe 48. As shown in FIG. 4, work platform 42 has two openings 50 spaced along the centerline of the work platform for the passage of the two posts 30. The framework 44 and underframe 48 are composed of tubular steel members into which may be removably fitted extension platform sections 52 at different levels, as shown in FIG. 2, and also in FIGS. 2 and 3 in the form of supports for supporting planking 54 close to a building wall 56 and arrangeable such as to follow the contour of the building wall, as shown in plan section in FIG. 4, so as to enable a workman A to stand close to the building wall to install a lining, for instance of bricks indicated at B, using mortar C.

As shown in FIG. 1, the scaffolding can be installed sufficiently spaced from a building wall 56, so as to completely clear any projections, such as balconies D and the like. The platform extensions are temporarily removed to clear each balcony as the brick laying work progresses upwardly along the wall.

As shown in FIGS. 2, 3, and 4, a railing or ramp 58 is removably fixed to three sides as a safety measure. Part of the railing can be used as an openable gate, as shown at 60 in FIGS. 3 and 4, to permit easier loading of the work platform when the latter is at substantially ground level. If desired, platform extensions can be installed at both ends of the main work platform 42, this to increase the width of the wall section accessible to the workers.

A swing stage 62 extends longitudinally of the work platform 42 underneath the same and is suspended therefrom by cables 64. Safety handrails 66 are also attached to the cables 64. Also, upright stabilizing rodes 68 are fixed to the swing stage 62 and carry a stop at their upper end. They are are slidably guided in sleeves 70 fixed to the work platform 42. Guide rods 68 laterally and longitudinally stabilize the swing stage 62, and positively stop the swing stage at its intended level below the platform 42.

This arrangement permits resting the swing stage on base 20 just underneath the work platform 42 when the latter is in completely lowered position, with underframe 48 resting on base 20 whereby the fully lowered platform and base occupy a minimum of height when not in use for easy transportation from one building site to another.

The swing stage 62 carries upright posts 72 (FIG. 2) provided with brackets 74 for supporting elongated cross-braces, not shown, to be installed by the workman, which has descended from the work platform onto the swing stage 62, so as to brace the two posts one with the other. These bracing bars are successively attached at their required height intervals, as the platform is being raised,and are similarly detached from the posts as the platform is being lowered, and the post sections successively dismantled. At the same time, as shown in FIG. 1, tie rods 76 supported by the brackets 64, are installed by the workman to tie the two posts to the building wall 56 as the platform is raised, so as to stabilize the posts in the direction toward and away from the building wall. When the platform is lowered, the tie-rods 76 are removed, again using the swing stage to gain access thereto. Eyes 78 have been previously fixed to the wall 56 and the tie-rods 76 are provided at one end with a hook 80 to engage the eyes 78. Tie rods 76 are fixed to posts 30 by adjustable tie-rod fasteners 81.

Figure 6:
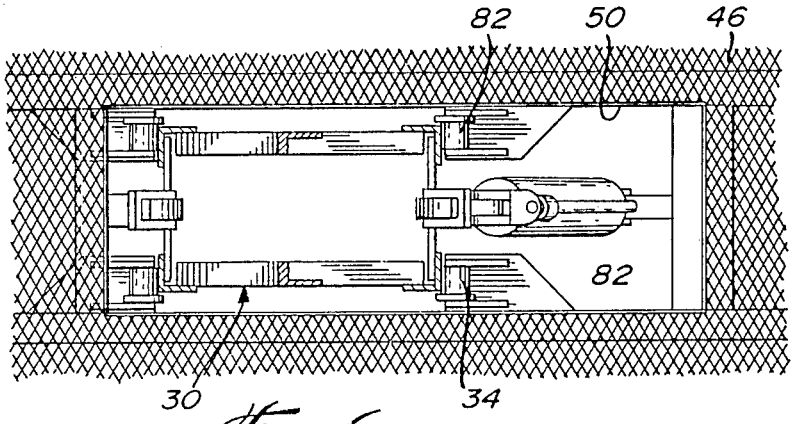
FIG. 6 is a plan section taken along line 6—6 of FIG. 5.

As shown in FIGS. 5 and 6, the work platform 42 is guided along the post 30 by means of two sets of flanged guide rollers 82 engaging the angle members 34 at the four corners of each post, one set at the level of the work platform 42, and the other set of flanged rollers 82 carried by the underframe 48 vertically below the first set of rollers, so as to better stabilize the platform transversely of thereof.

Figure 7:
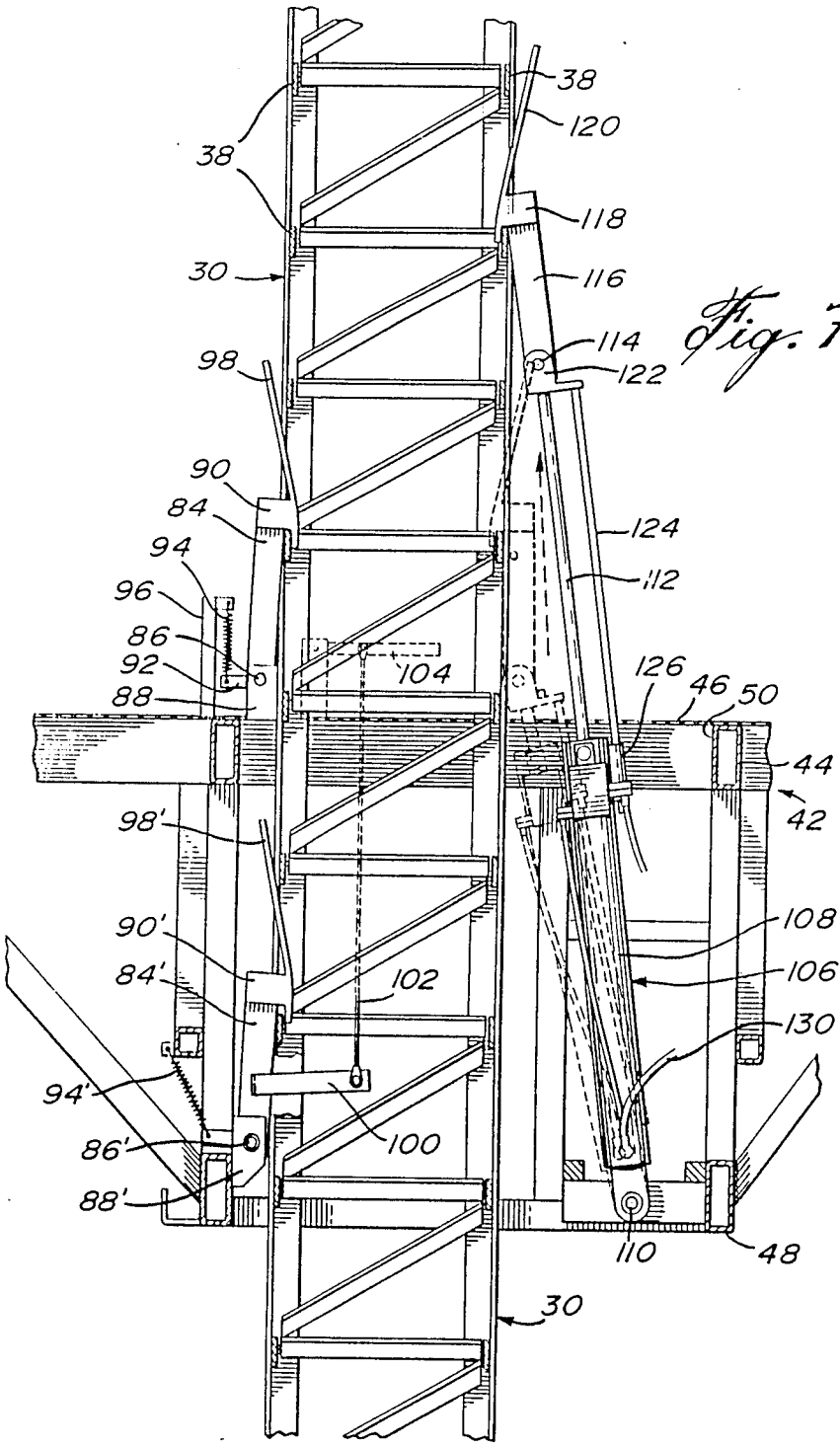
FIGS. 7 to 11 are vertical sections similar to that of FIG. 5, but showing the various elements for raising and lowering the platform along the post and showing the successive positions taken by these elements.
Figure 8:
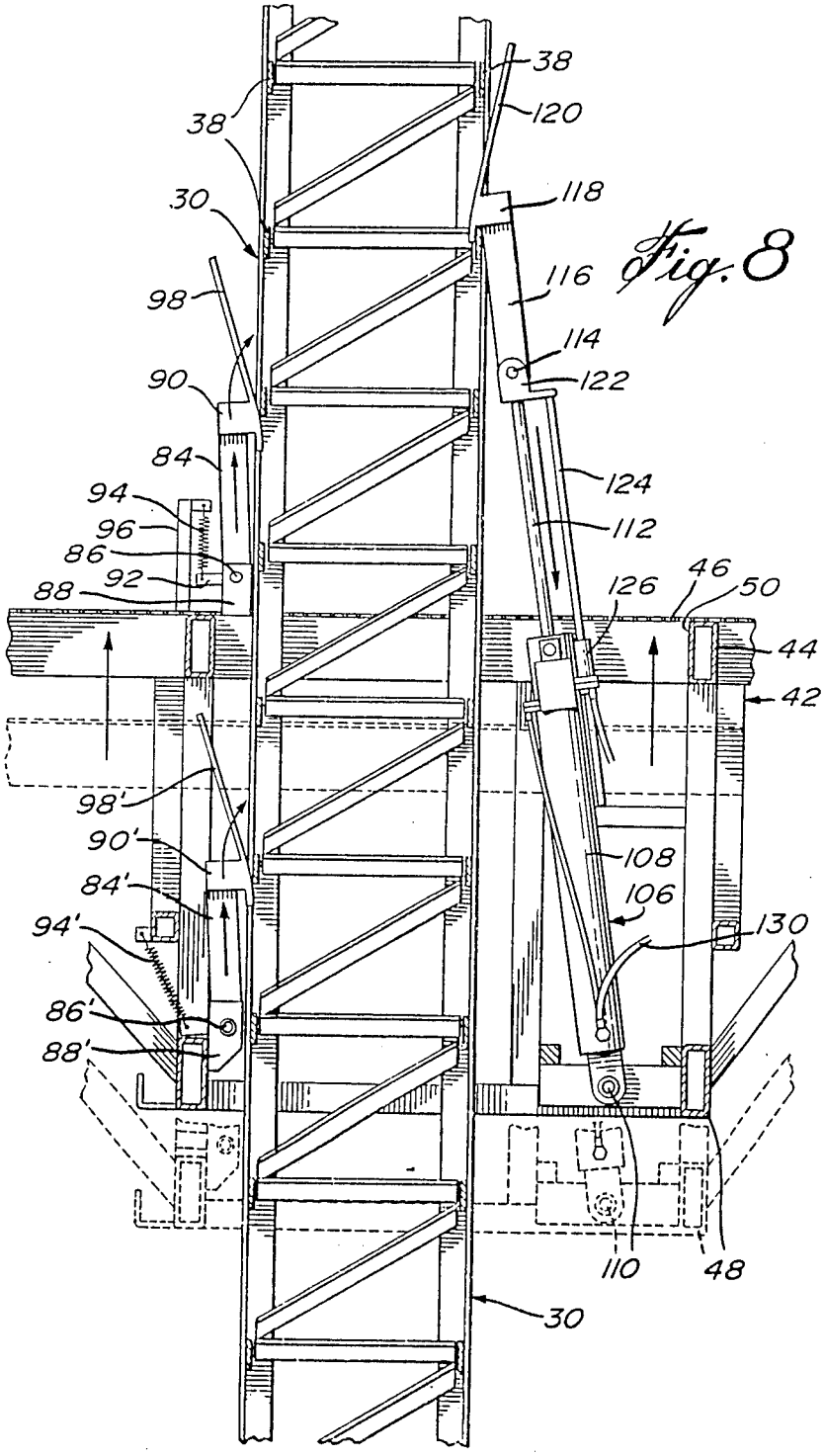

FIG. 7 shows the means to suspend the platform from each post and to raise and lower the platform along the posts. An arm 84 extends on one side of each post and is pivoted at 86 to ears 88 fixed to the work platform framework 44. The upper end of each arm 44 carries a downwardly-opening hook member 90 removably engageable with anyone of the transverse bars 38 of the post sections 32 to suspend the platform therefrom. The lower end of each arm 84 is provided with a side arm 92 to which is attached a tension spring 94, the other end of which is attached to a post 96 fixed to the platform 42. Spring 94 constantaly biases the arm 84 towards the post 30. A guide bar 98 upwardly extends from the hook 90, being secured thereto. When hook 90 engages a transverse bar 38, the guide bar 98 outwardly clears the next higher bar 38. Upon raising of the platform along the post, the guide bar 98 slides along the next higher transverse bar or step 38, as shown in FIG. 8, so as to clear the same during raising of the platform. Once the hook has upwardly cleared the next higher transverse bar, the tension spring 94 automatically biases the arm 84 towards the post, so that its hook 90 will then engage the next higher transverse bar 38.

Figure 9:
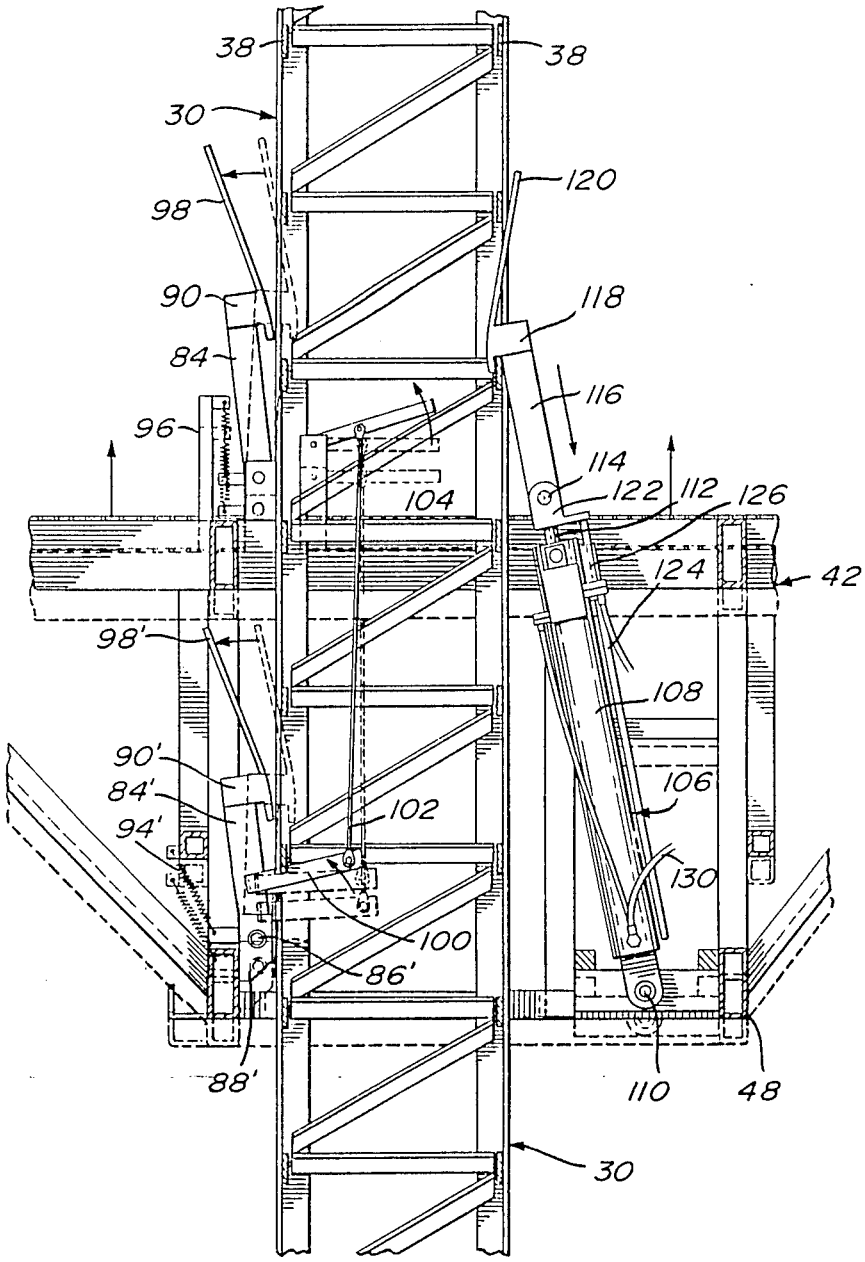

As a safety measusre, a duplicate arrangement of an arm 84', pivot 86', ears 88', hook 90', side arm 92', tension spring 94' and guide bar 98' are mounted on the underframe 48 vertically below the first anchoring system, so that the two hooks 90, 90' may engage different transverse bars at the same time, as shown in FIG. 7. This figure shows also a manually-operated means to remotely pivot the lower arms 84' outwardly, so as to clear the transverse steps 38 of the two posts during lowering of the platform. These means include a side arm 100 fixed to the lower arm 84' and attached by a link 102 to an operating lever 104 pivoted on the work platform 42 in a position accessible to the workman on the platform, as to release the lower hook. The upper hook can be released by outwardly pulling the guide bar 98 when clearing step 38 as shown in FIG. 9.

As shown in FIG. 7, when the upper hook 90 engages a transverse bar 38, the lower hook 90' just upwardly clears the same, the entire platform load being supported by the upper hook, so that the lower hook will be in a condition to support the platform should the upper hook fail or should its transverse bar fail.

The other anchoring member of the pair is shown at 106 in FIG. 7, it is power actuated and generally shown at 106; it is longitudinally extendible and retractable, so as to raise or lower the platform relative to the posts.

Extendible member 106 includes a double-acting hydraulic ram 108 pivoted at its lower end at 110 to the underframe 48 of the work platform and extending upwardly therefrom through the opening 50 of the work platform. The ram 108 has a piston rod 112 extending upwardly from the platform and to the upper end of which is pivoted at 114 a rigid arm 116, to the upper end of which is secured a downwardly-opening hook member 118, similar to hook 90, and also provided with an upwardly-inclined guide bar 120, similar to guide bar 98 and for the same purpose.

To constantly orientate the hook 118 towards the transverse bars 38 of the post, and to guide pivotal movement of the arm 116 towards and away from the post despite possible rotation of the piston rod 112 in the ram 108, a bracket 122 is fixed to the upper end of the piston rod 112, said bracket carrying the pivot 114 and also a guide rod 124 which extends downwardly, parallel to the piston rod 112, and is guided in a sleeve 126 fixed to the upper end of the cylinder of the ram 108.

As shown in FIG. 7, the pivot 110 of the lower end of the ram 108 to the underframe 48 is sufficiently spaced from the post 130, so that the center of gravity of the ram and hook system is always between the pivot 108 and the post. Therefore, this constitutes a biasing means constantly and automatically urging the hook 118 against the post, so as to cause automatic engagement of the hook 118 with a transverse step bar 38 as the platform is being lowered or raise.

As shown in FIG. 7, the stroke of the ram 108 is at least equal to slightly more than the vertical spacing between two adjacent step bars 38 of the post 30; but, in practice, in order to accelerate raising and lowering of the platform, the stroke is equal to a little more than the distance between three step-bars, so as to raise or lower the platform two steps at the time with a single stroke of ram 108, so as to accelerate the lowering or raising procedure.

Figure 10:
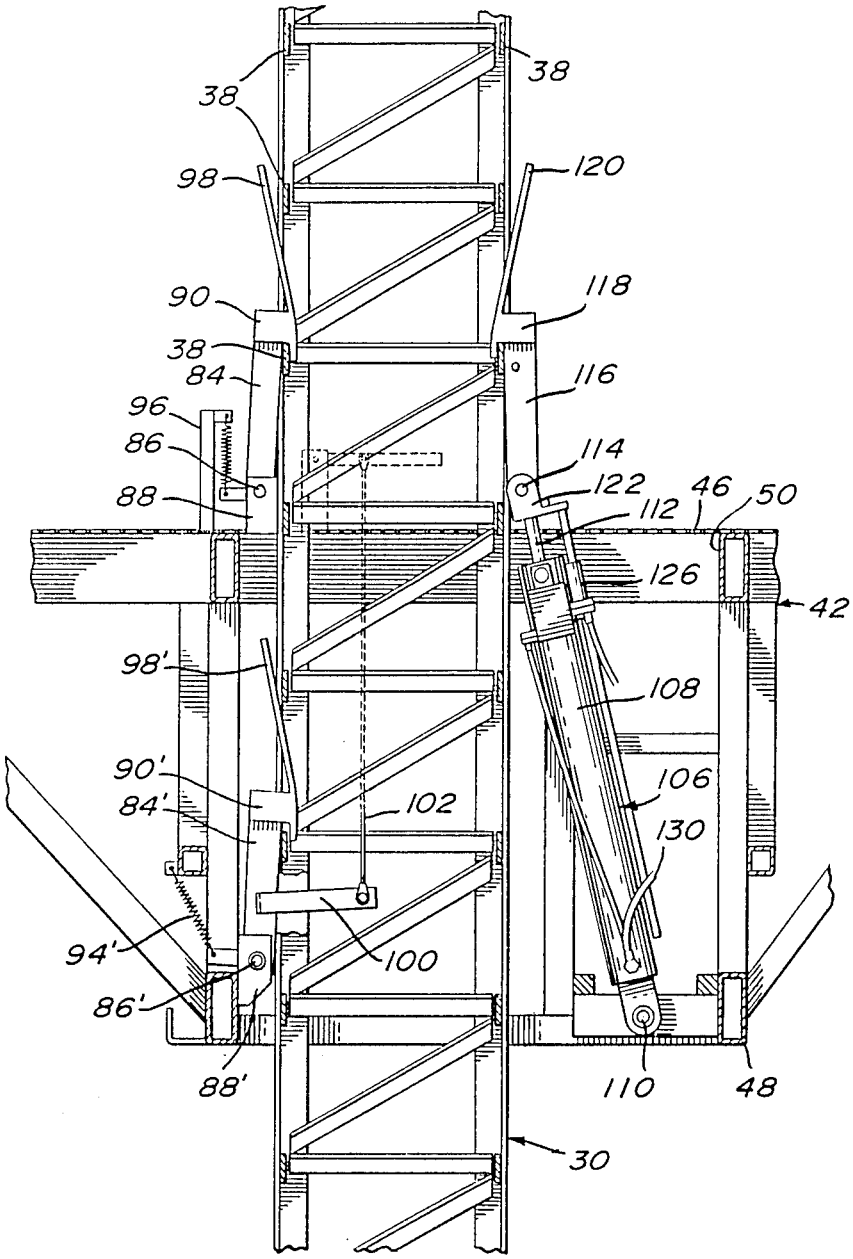

In FIG. 7, hook 90 solely suspends the work platform Hook 118 is raised by the piston rod 112 from its dotted-line position to a position slightly higher than the second higher step 38 and then slightly lowered to engage said last-named step. Then, upon retraction of the piston rod 112, as shown in FIG. 8, the whole platform is raised; the hook 90 clears the next two higher steps (see FIGS. 8 and 9) until the piston rod 112 is fully retracted, at which position the hook 90 is slightly higher and clears the adjacent step bar 38. Then the piston rod 112 is slightly extended to slightly lower the platform and cause the hook 90 to fully engage the adjacent step bar 38, as shown in FIG. 10. The platform is safely suspended and the cycle is repeated.

Figure 11:
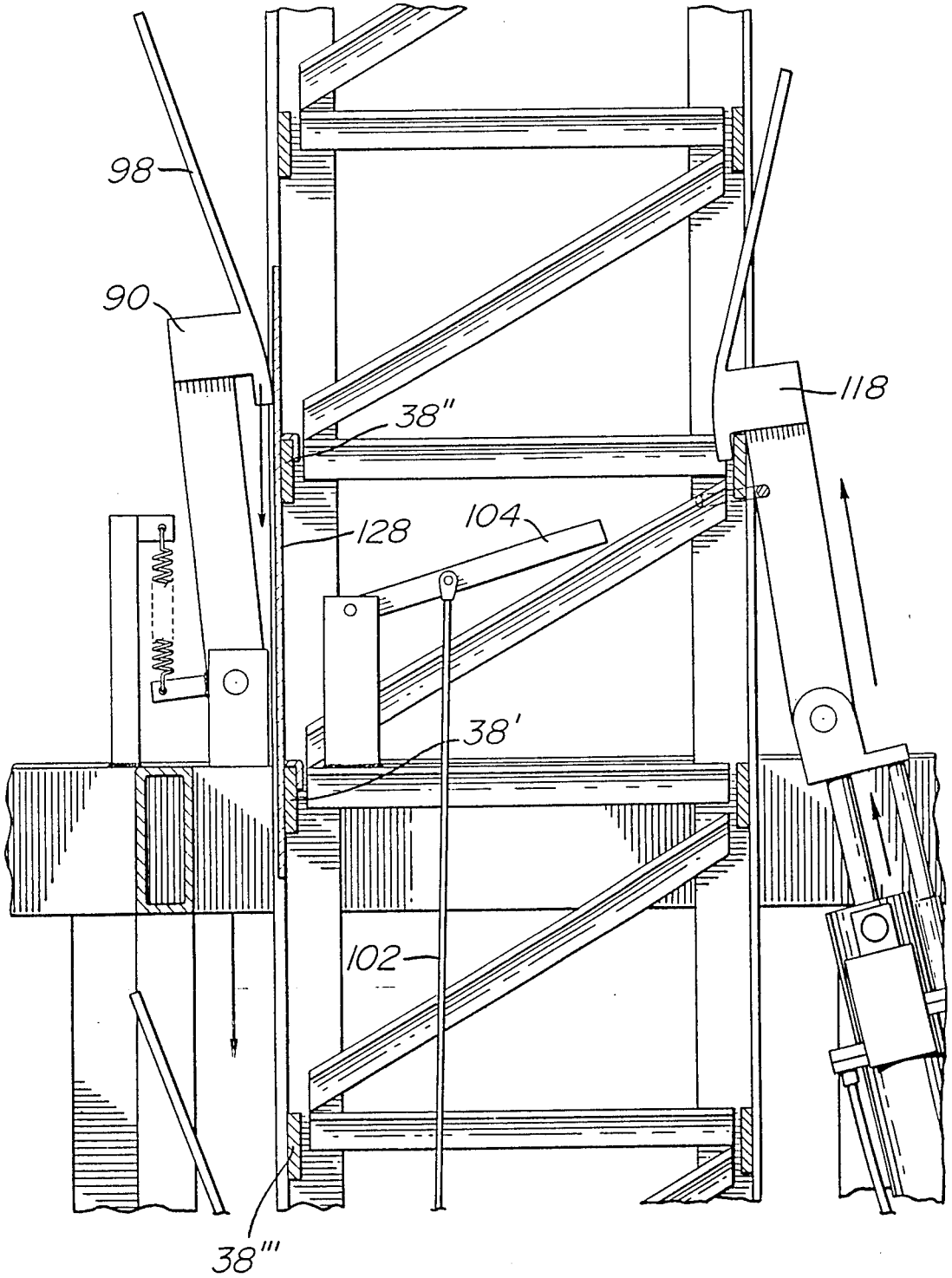

Lowering of the platform is again effected two steps at a time, as shown in FIG. 11. In order to clear the upper hook 90 from an intervening step 38', after slightly raising platform 42 so that hook 90 clears step 38'' and after pulling on guide bar 98, a plate 128 is temporarily suspended from said steps 38' and 38'' so that hook 90 will only engage step 38'''. During this lowering operation, lever 104 is operated to cause clearance of the lowermost hook 90'. Of course, the two lowermost hooks 90' may be interconnected from one post to the other, so that a single-operating arm or lever 104 will operate both lower hooks.

The arm 116 of the extendible assembly 106 is pivoted at 114 to the piston rod bracket 122 to prevent any stress on the piston rod and its movement within the ram 110. As shown in FIG. 10, when the ram is not operating, the arm 116 simply rests on the post and when the arm is under tension, the piston rod automatically aligns itself with said arm. Preferably, a coil spring is arranged at pivot 114 to constantly bias the arm 116 towards the post 30.

The two rams 108 are connected hy a hydraulic circuit, including the tubing 130, to a hydraulic pump (not shown) located within a box 132 (FIG. 3) mounted on the work platform itself 42 adjacent one post 30. The box 132 also encloses an internal combustion engine for driving the hydraulic pump. The hydraulic circuit is controlled by hydraulic valves (not shown) operated by control levers 134 by the workman standing on the platform.

It has been found that a single workman can effect the entire procedure of raising or lowering the platform, including the installation of post section 32, as the platform is being raised; the removal of the same as the platform is being lowered and including descending on the swing stage for the installation or removal of the cross-braces interconnecting the two posts and of the tie-rods 76 inter-connecting each post to the adjacent wall 56.

It has been found that the platform is sufficiently strong and the hydraulic system sufficiently powerful to raise a platform, including the necessary number of workmen, the entire load of bricks and mortar sufficient to lay bricks or a multi-storey building along a width equivalent to the length of the work platform and of even an extension therefor. It additional building material is needed, a hoist system can be installed on the work platform to raise the same. The scaffolding is quickly installed and dismantled, and when completely dismantled, occupies of minimum of room to be easily transported to another building site.

In this connection and referring to FIG. 3, it has been found that a set of wheels can be installed at 136 to the underframe and a hitching device installed at 138 to the opposite end, so as to be easily pulled as a semi-trailer by a towing truck, the platform being completely lowered to the base 20 and the latter locked under the platform.

What I claim is:

1. A scaffolding comprising a base, a pair of spaced posts secured to and upstanding from said base, each post formed of modular post sections, fastener means to releasably and successively secure said post sections on top of one another, said posts defining substantially, equally-spaced step means, a work platform surrounding said posts and capable of being raised and lowered relative to said posts, a pair of anchoring members pivotally carried by said platform adjacent each post, and alternately and successively engageable with said step means to suspend said work platform from said posts at different levels, at least one anchoring member of said pair being a power-actuated member extendible and retractable along said posts relative to said work platform through a stroke at least equal to the vertical spacing between adjacent step means, said platform raisable and lowerable by said extendible members, biasing means associated with said anchoring members to cause automatic engagement of said anchoring members with said step means as said platform is raised or lowered, and the other member of said pairs alternatively engaging said step means to suspend said platform as the latter is raised or lowered by the extendible members of said pairs, said post sections arranged to be secured or removed by a workman on said platform onto or from the topmost secured post sections when said platform is at general level of said topmost secured post sections.

2. A scaffolding as defined in claim 1, wherein each post section includes a lattice framework of quadrangular crosssection forming longitudinal corner members interconnected by transverse bars which constitute said step means; and wherein said extendible member includes a double-acting hydraulic ram pivoted at one end to said platform and having a piston rod extended from its outer end and forming at its outer end a transverse bar-engaging part.

3. A scaffolding as defined in claim 2, wherein said ram is pivoted at its lower end and extends upwardly therefrom and said transverse bar-engaging part is formed at the upper end of said piston rod, said ram and piston rod being upwardly inclined towards said post, the center of gravity of said ram and piston rod lying between said post and the pivotal connection of said ram to said platform, thereby constituting the biasing means causing automatic engagement of the transverse bar-engaging part with any transverse bar.

4. A scaffolding as defined in claim 3, wherein said transverse bar-engaging part is a downwardly-extending first hook for partly surrounding the top portion of any transverse bar.

5. A scaffolding as defined in claim 4, further including a first guide member secured to and upstanding from said first hook and slidable along the next higher transverse bar during raising of said work platform to pivot said ram away from said post against the bias of its biasing means and allow said first hook to clear the next higher transverse bar.

6. A scaffolding as defined in claim 2, wherein the other one of the pair of anchoring members is an arm extending along said post, pivoted to said platform at its lower end and forming a downwardly-engaging opening second hook at its upper end, said second hook engageable with successive transverse bars under the action of the biasing means associated with said arm as said platform is raised or lowered.

7. A scaffoling as defined in claim 5, wherein the other one of the pair of anchoring members is a first arm extending along said post, pivoted to said platform at its lower end and forming a downwardly-engaging opening second hook at its upper end, said second hook engageable with successive transverse bars under the action of the biasing means associated with said first arm as said platform is raised or lowered.

8. A scaffolding as defined in claim 7, wherein the biasing means associated with said first arm includes a spring attached to said platform and to said first arm.

9. A scaffolding as defined in claim 7, further including a second arm extending along said post and pivoted to said platform spacedly below said first arm, said second arm carrying a downwardly opening third hook at its upper end, engageable with another transverse bar and substantially simultaneously with the second hook; and manually-operated means to release said second and third hooks from engagement with said bars to clear the latter when said platform is being lowered.

10. A scaffolding as defined in claim 9, further including a second and a third guide member secured to and upstanding from said second and third hooks, respectively, and slidable from the next higher transverse bars during raising of said platform to pivot said second and third arms away from said post and to allow said second and third hooks to clear the next higher transverse bars.

11. A scaffolding as defined in claim 1, further including a swing-stage means suspending said swing stage from said platform, said swing stage extending at least from one post to the other and carrying supports for bracing bars accessible to an operator standing on said swing stage, said swing stage allowing said operator to install said bracing bars diagonally across said two posts and secure said bracing bars to said posts.

12. A scaffolding as defined in claim 11, further including tie-rods adapted to be supported in said supports carried by said swing stage, said tie-rods having means to fix the same to said posts and to an adjacent building wall, to stabilize said posts and said platform along said building wall.

13. A swing stage as defined in claim 2, further including a hydraulic supply circuit connected to said hydraulic rams; lever means for controlling said hydraulic supply circuit, said hydraulic supply circuit and said lever means mounted on said platform and accessible to a worker on said platform.

14. A scaffolding as defined in claim 12, further including modular work platform extensions releasably attachable to said work platform and arranged to conform to the contour of an adjacent building wall to gain access thereto from said work platform.

15. A scaffolding as defined in claim 2, wherein said work platform includes an underframe rigid therewith and further including guide rollers carried in vertically-spaced pairs by said work platform and said underframe and in rolling contact with said corner members to stabilize said work platform relative to said posts.

16. A scaffolding as defined in claim 4, wherein said first hook is formed at the upper end of a rigid link, the lower end of which is pivoted to the upper end of said piston rod, transversely of said piston rod, and further including a guiding rod extending parallel to and spaced from said piston rod and rigidly secured at its upper end to the upper end of said piston rod; and a guiding sleeve fixed to the upper end of said ram and slidably receiving said guiding rod.

* * * * *